US009670751B2

(12) United States Patent
Brasseaux et al.

(10) Patent No.: US 9,670,751 B2
(45) Date of Patent: Jun. 6, 2017

(54) SLIDING SLEEVE HAVING RETRIEVABLE BALL SEAT

(71) Applicant: Weatherford Technology Holdings, LLC, Houston, TX (US)

(72) Inventors: Jason J. Brasseaux, Houston, TX (US); Cesar G. Garcia, Katy, TX (US); David G. Ward, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/857,519

(22) Filed: Sep. 17, 2015

(65) Prior Publication Data

US 2016/0084040 A1 Mar. 24, 2016

Related U.S. Application Data

(60) Provisional application No. 62/053,032, filed on Sep. 19, 2014.

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/14* (2013.01); *E21B 2034/007* (2013.01)

(58) Field of Classification Search

CPC ..... E21B 2034/007; E21B 34/10; E21B 34/14
See application file for complete search history.

(56) References Cited

U.S. PATENT DOCUMENTS

| | | | | |
|---|---|---|---|---|
| 8,397,820 | B2 * | 3/2013 | Fehr | E21B 33/124 166/318 |
| 9,187,994 | B2 * | 11/2015 | Themig | E21B 34/103 |
| 2009/0014168 | A1 * | 1/2009 | Tips | E21B 33/14 166/73 |
| 2010/0252280 | A1 * | 10/2010 | Swor | E21B 43/14 166/386 |
| 2011/0100643 | A1 * | 5/2011 | Themig | E21B 34/102 166/373 |
| 2011/0192613 | A1 | 8/2011 | Garcia et al. | |
| 2012/0055684 | A1 | 3/2012 | Zimmerman et al. | |
| 2012/0305265 | A1 | 12/2012 | Garcia et al. | |

(Continued)

OTHER PUBLICATIONS

First Office Action in counterpart Canadian Appl. 2,904,312, dated Aug. 25, 2016, 4-pgs.

*Primary Examiner* — James G Sayre
(74) *Attorney, Agent, or Firm* — Blank Rome LLP

(57) ABSTRACT

A sliding sleeve opens with a deployed ball and applied pressure and is subjected to reverse flow pressure. The sleeve has a housing and an insert. The housing defines a first bore and defines a flow port communicating the first bore outside the housing. The insert is disposed in the first bore of the housing and has a seat held in a first direction therein. The seat engages the deployed plug in the first direction, and the insert moves, by the applied pressure against the plug engaged in the seat, axially in the first direction inside the first bore from a closed position toward an opened position relative to the flow port. The seat is disengageable from the insert in a second direction opposite to the first direction by the reverse flow and is passable at least out of the insert.

24 Claims, 5 Drawing Sheets

(56) References Cited

U.S. PATENT DOCUMENTS

| | | | | |
|---|---|---|---|---|
| 2013/0043042 | A1 | 2/2013 | Flores et al. | |
| 2013/0192846 | A1 | 8/2013 | Garcia et al. | |
| 2014/0166292 | A1 | 6/2014 | Crowley et al. | |
| 2014/0166303 | A1 | 6/2014 | Garcia | |
| 2014/0251594 | A1 | 9/2014 | Garcia et al. | |
| 2014/0251628 | A1 | 9/2014 | Wilkin et al. | |
| 2015/0129229 | A1 | 5/2015 | Ring et al. | |
| 2015/0152710 | A1 | 6/2015 | Andersen et al. | |
| 2015/0152714 | A1 | 6/2015 | Andersen et al. | |
| 2015/0369010 | A1* | 12/2015 | Themig | E21B 34/14 166/305.1 |

* cited by examiner

SLIDING SLEEVE HAVING RETRIEVABLE BALL SEAT

CROSS-REFERENCE TO RELATED APPLICATIONS

This application claims the benefit of U.S. Provisional Appl. 62/053,032, filed 19 Sep. 2014, which is incorporated herein by reference.

BACKGROUND OF THE DISCLOSURE

In a staged fracturing operation, multiple zones of a formation need to be isolated sequentially for treatment. To achieve this, operators install a fracturing assembly downhole in the wellbore, which typically has a top liner packer, open hole packers isolating the wellbore into zones, various sliding sleeves, and a wellbore isolation valve. When the zones do not need to be closed after opening, operators may use single shot sliding sleeves for the fracturing treatment. These types of sleeves are usually ball-actuated and lock open once actuated. Another type of sleeve is also ball-actuated, but can be shifted closed after opening.

Initially, operators run the fracturing assembly in the wellbore with all of the sliding sleeves closed and with the wellbore isolation valve open. Operators then deploy a setting ball to close the wellbore isolation valve. This seals off the tubing string of the assembly so the packers can be hydraulically set. At this point, operators rig up fracturing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

FIG. 1A shows an example of a sliding sleeve 10 for a multi-zone fracturing system in partial cross-section in an opened state. This sliding sleeve 10 is similar to Weatherford's ZoneSelect MultiShift fracturing sliding sleeve and can be placed between isolation packers in a multi-zone completion. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the inner sleeve 30 positions in the housing 20 in a closed state. A breakable retainer 38 initially holds the inner sleeve 30 toward the upper sub 22, and a locking ring or dog 36 on the sleeve 30 fits into an annular slot within the housing 20. Outer seals on the inner sleeve 30 engage the housing 20's inner wall above and below the flow ports 26 to seal them off.

The inner sleeve 30 defines a bore 35 having a seat 40 fixed therein. When an appropriately sized ball B lands on the seat 40, the sliding sleeve 10 can be opened when tubing pressure is applied against the seated ball B to move the inner sleeve 30 open. To open the sliding sleeve 10 in a fracturing operation once the appropriate amount of proppant has been pumped into a lower formation's zone, for example, operators drop an appropriately sized ball B downhole and pump the ball B until it reaches the landing seat 40 disposed in the inner sleeve 30.

Because the zones of a formation are treated in stages with the sliding sleeves 10, the lowermost sliding sleeve 10 has a ball seat 40 for the smallest ball size, and successively higher sleeves 10 have larger seats 40 for larger balls B. In this way, a specific sized ball B dropped in the tubing string will pass though the seats 40 of upper sleeves 10 and only locate and seal at a desired seat 40 in the tubing string.

Once the ball B is seated, built up pressure forces against the inner sleeve 30 in the housing 20, shearing the breakable retainer 38 and freeing the lock ring or dog 36 from the housing's annular slot so the inner sleeve 30 can slide downward. As it slides, the inner sleeve 30 uncovers the flow ports 26 so flow can be diverted to the surrounding formation. The shear values required to open the sliding sleeves 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

After the fracturing job, the well is typically flowed clean, and the ball B is floated to the surface. Then, the ball seat 40 (and the ball B if remaining) is milled out. The ball seat 40 can be constructed from cast iron to facilitate milling, and the ball B can be composed of aluminum or a non-metallic material, such as a composite. Once milling is complete, the inner sleeve 30 can be closed or opened with a standard "B" shifting tool on the tool profiles 32 and 34 in the inner sleeve 30 so the sliding sleeve 10 can then function like any conventional sliding sleeve shifting with a "B" tool. The ability to selectively open and close the sliding sleeve 10 enables operators to isolate the particular section of the assembly.

The standard fracture sleeve system as noted above uses graduated ball seats that are permanently installed into the sleeves during the fracturing operation. Once all of the sleeves have been opened, reservoir pressure is then relied upon to pump the balls off the seats so the balls can then float and be carried by flow back to surface. In the case where a ball fails to pump off the seat or if a larger flow area is desired, operators run an intervention to mill out the ball and seats to remove the obstructions.

To facilitate milling, anti-rotation features have been added to the inserts in the sliding sleeves in both the opened and closed position so that the ball and seat can be milled out in any orientation. Also, dissolvable ball materials have been used to eliminate the potential need for milling.

The subject matter of the present disclosure is directed to overcoming, or at least reducing the effects of, one or more of the problems set forth above.

SUMMARY OF THE PRESENT DISCLOSURE

A sliding sleeve is run on a tubing string in a well. The sliding sleeve opens with a deployed plug and applied pressure and is subjected to reverse flow pressure. The sleeve includes a housing, an insert, and a seat. The housing defines a first bore and can define a flow port communicating the first bore outside the housing. The insert is disposed in the first bore of the housing and has a second bore therethrough in which the seat is held in a first direction. The insert can be an inner sleeve with seals disposed thereabout for sealing the flow port with the inner sleeve in the closed position.

During operations, the seat engages the deployed plug in the first direction, and the insert can move, by the applied pressure against the plug engaged in the seat, in the first direction inside the first bore. For example, the insert can move from a closed position toward an opened position relative to the flow port.

The seat is disengageable from the insert in a second direction opposite to the first direction by the reverse flow pressure coming from downhole in the tubing string. At that point, the disengaged seat is passable out of the insert in the second direction and can flow uphole. A retention element holds the seat in the first direction in the second bore of the inner sleeve, but the retention element can release the seat in the second bore in the second direction in response to a predetermined level of the reverse flow pressure. For example, this retention element can be a ring engaged in a slot about the seat and held in a groove about the second bore of the insert. The ring can have an end allowing passage of a shoulder of the slot in the second direction.

Another retention element can temporarily hold the insert in the closed position until the applied pressure against the engaged plug in the seat breaks the temporary hold so the insert can move toward the opened position. For example, this second retention element can be a shear ring shareable in response to movement of the insert in the first direction.

Yet another retention element can then hold the insert in the opened position inside the housing's bore. This third retention element can be a lock ring held in a slot about the insert and engageable in a groove about the first bore of the housing.

To help engage the plug deployed to the seat, the seat can have a surface engageable with the deployed plug and configured to at least partially hold the deployed plug in the second direction. For example, the seat can have a contoured surface, a knurled surface, a ribbed surface, a conical surface, a wedged surface, or the like.

To facilitate the reverse flow move the seat, one or more seals can be disposed on the seat sealing with surrounding surfaces. For example, one or more fins can be disposed on the seat and adapted to seal with the second bore of the insert and the first bore of the housing when passing therethrough. At least one seal can be disposed at a first end of the seat and can seal a space between the seat and the second bore of the insert while the seat is held therein. Another seal can be disposed at a second end of the seat and can be adapted to seal a space between the seat and the first bore of the housing.

A wellbore treatment system according to the present disclosure can include a plurality of such sliding sleeves. Each sliding sleeve opens with one of a plurality of deployed plugs and applied pressure. Each of the plugs can have different sizes to pass through successive sleeves and engage lower ones of the seats so sleeves can be successively opened and treatment can be performed up the tubing string.

In treating a well with plugs and applied pressure, which is followed with reversed flow pressure, a treatment method can involve engaging one of the plugs on the seat of the insert in one of the sliding sleeves disposed in the well. The insert is then opened relative to the flow port on the sliding sleeve by moving the insert in the first direction with the applied pressure against the engaged plug.

Eventually, the method involves disengaging that seat having the engaged plug from the insert in response to the reversed flow pressure and involves flowing the disengaged seat having the engaged plug in a second direction opposite to the first direction using the reversed flow pressure. Disengaging the seat having the engaged plug from the insert in response to the reversed flow pressure can involve releasing a temporary connection of the seat to the insert in the sliding sleeve. Meanwhile, a sleeve of the insert can be locked in the open condition in the sliding sleeve to allow the seat to disengage from the locked sleeve.

The foregoing summary is not intended to summarize each potential embodiment or every aspect of the present disclosure.

DETAILED DESCRIPTION OF THE DISCLOSURE

Figure 1A:
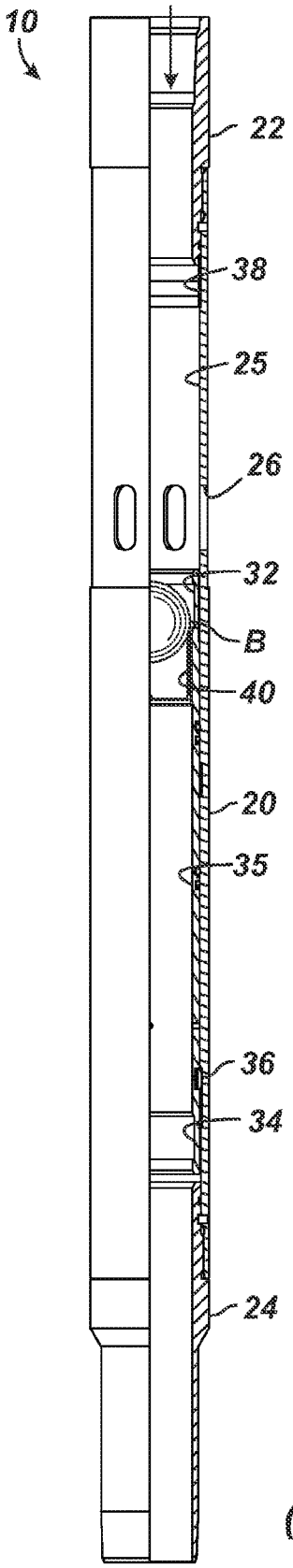
FIG. 1A (Prior Art)
FIG. 1A illustrates a sliding sleeve having a ball engaged with a seat to open the sliding sleeve according to the prior art.
Figure 1B:
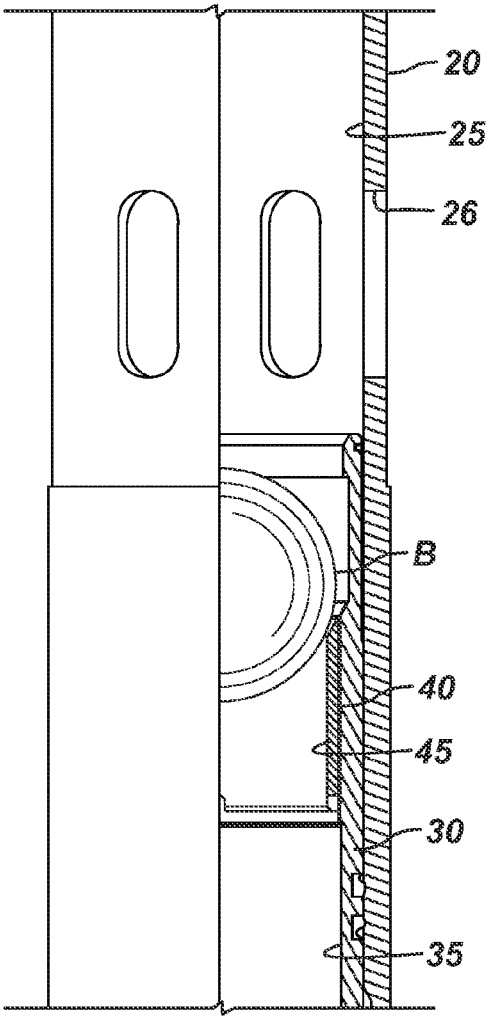
FIG. 1B (Prior Art)
FIG. 1B illustrates a close up view of the sliding sleeve in FIG. 1B.
Figure 2:
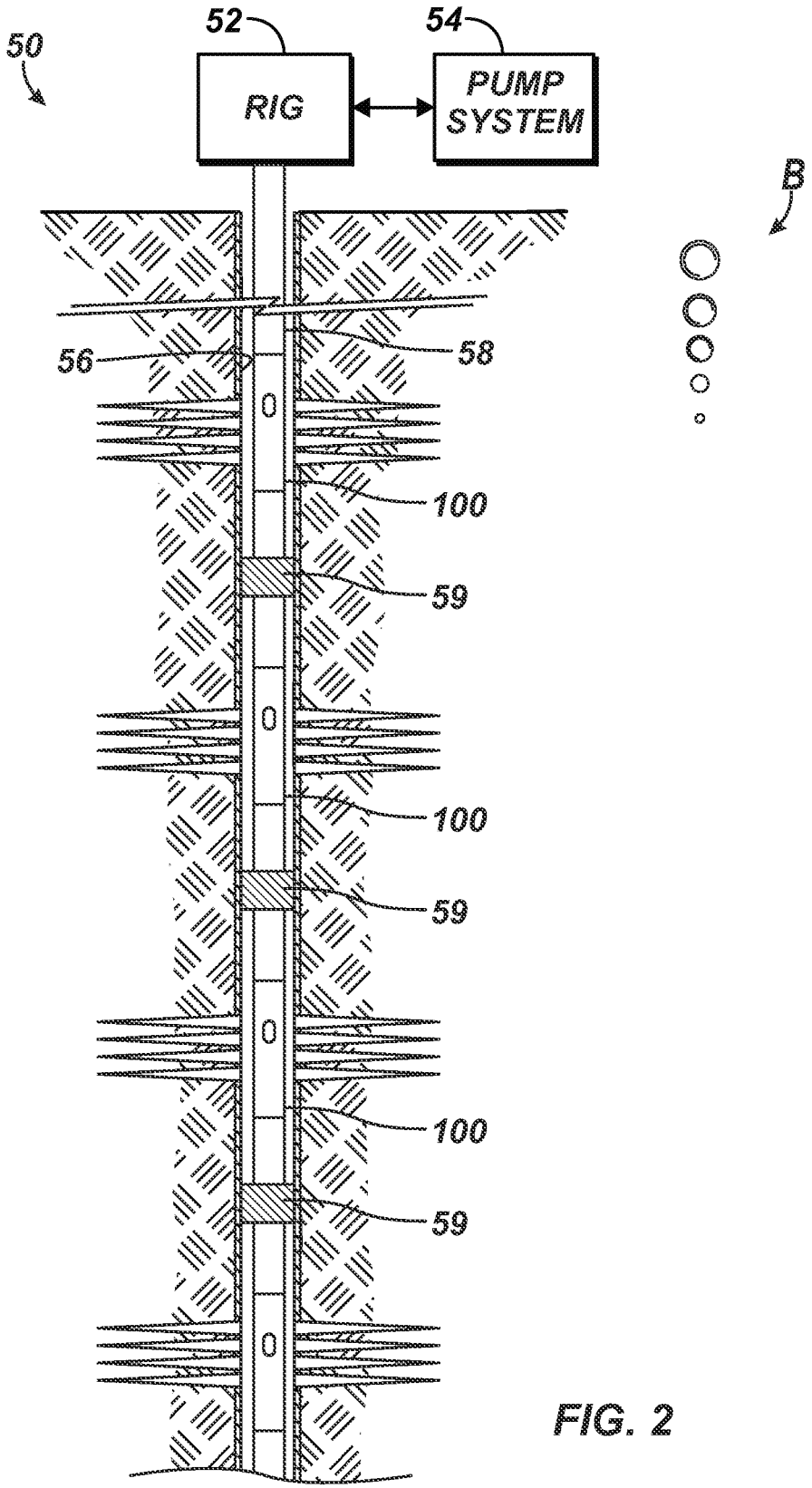
FIG. 2 illustrates a fracturing assembly disposed in a wellbore and having a plurality of fracturing sleeves according to the present disclosure.

FIG. 2 illustrates a fracturing assembly 50 having a plurality of fracturing sleeves 100 disposed on a casing string 58 in a wellbore 56. Packers 59 may be used between various sleeves 100 to create isolated zones for the formation. The sleeves 100 are actuated by successively dropping larger sized ball, plugs, or similar devices. When a ball B is dropped from the rig 52 to the farthest sleeve 100, for example, the ball B engages a seat (not shown) in the sleeve 100, and applied fluid pressure from the pump system 54 opens the sleeve 100. While the sleeve 100 is open and the seated ball B prevents the applied pressure from traveling further down the casing string 58, fracture treatment can be applied to the formation adjacent the open sleeve 100. Although a ball B is the particular device discussed herein, it will be appreciated that any suitable plugging device, such as a ball, dart, plug, element, etc. can be used.

When this operation is done, the next largest ball B can be deployed to the next sliding sleeve 100 so fracturing treatment can be applied to the next zone of the formation. This process is then repeated up the borehole 56. Once all operations are completed, the balls B and seats in the sleeves 100 can be floated to the surface in a manner discussed below. The sleeves 100 can be kept open or may be shifted closed depending on the implementation.

Figure 3A:
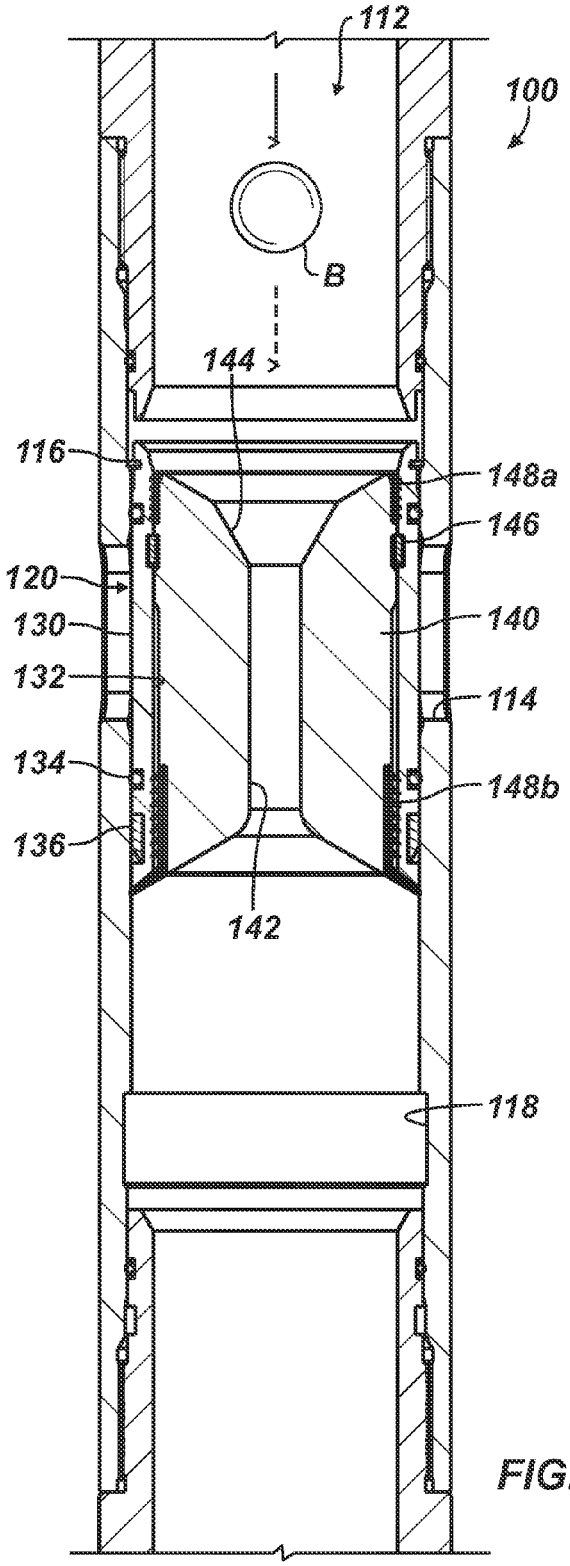
FIG. 3A illustrates a cross-sectional view of a fracturing sleeve according to the present disclosure in a closed condition.

FIG. 3A illustrates a sliding sleeve 100 in a closed condition and having an insert 120 according to the present disclosure in a first (upward) position. The sliding sleeve 100 can be part of a multi-zone fracturing system, which uses the sliding sleeve 100 to close and open communication with a borehole annulus. In such an assembly as shown in FIG. 2, the sliding sleeve 100 can be placed between isolation packers (59) in the multi-zone completion.

The sliding sleeve 100 includes a housing 110 with a throughbore 112. The insert 120 can move within the housing 110 to close or open fluid flow through the housing's flow ports 114 based on the insert's position. The insert 120 includes an inner sleeve 130 and a seat 140. The seat 140 is affixed in one direction inside the inner sleeve 130 using a retention feature 146. Any number of retention features 146 could be used, including, but not limited to, a shear pin, a shear screw, a shear ring, a snap ring, a latch ring, etc. The retention feature 146 can temporarily affix the seat 140 in the inner sleeve 130 in one (uphole) direction up to a first pressure limit (i.e., from pressure below), but can affix the seat 140 in the inner sleeve 130 in the opposite (downhole) direction to a greater extent (i.e., from fracture pressure above).

As particularly shown here, the retention feature 146 is a shouldered ring that fits in an inside groove of the sleeve 130 and fits in an external profile or slot on the seat 140. (See FIG. 3C). The ring 146 is engaged in the slot about the seat 140, but is held with abutting shoulders in the groove about the bore of the sleeve 140. The ring's end and the seat's slots allow passage of a shoulder of the slot in the second direction past the ring 146.

Figure 3B:
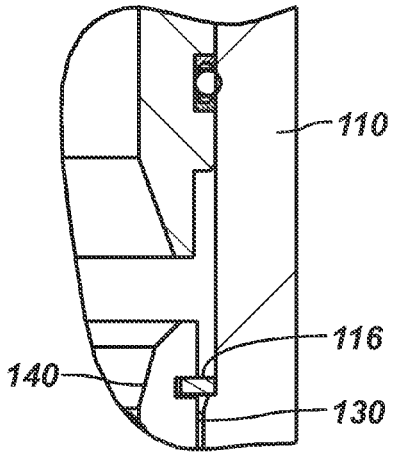
FIG. 3B illustrates a detail of a temporary connection for the insert of the disclosed fracturing sleeve.

When initially run downhole, the insert 120 positions in the housing 110 in a closed state, as in FIG. 3A. A retaining element 116 (FIG. 3B), such as a shear ring, temporarily holds the insert 120 toward the upper end, and outer seals 134 (FIGS. 3C-3D) on the insert 120 engage the housing 110's inner bore 132 both above and below the flow ports 114 to seal them off. As an option, the flow ports 114 may be covered by a protective sheath (not shown) to prevent debris from entering into the sliding sleeve 100.

The sliding sleeve 100 is designed to open when a particularly sized ball B lands on the seat 140 and tubing pressure is applied to move the insert 120 open. (Although a ball B is shown and described, any conventional type of plug, dart, ball, cone, or the like may be used. Therefore, the term "ball" as used herein is meant to be illustrative.) Before the particular ball is deployed, the sliding sleeve 100 functions as normal to allow smaller balls B to drift through the sleeve 100 and the seat's passage 142 to further downhole parts of the completion until the proper sized ball B is dropped. Once the appropriate ball B has landed on the seat 140, pressure increased behind the seated ball B eventually shears the shear ring 116 and pushes the insert 120 of the sleeve 100 opened.

Figure 3C:
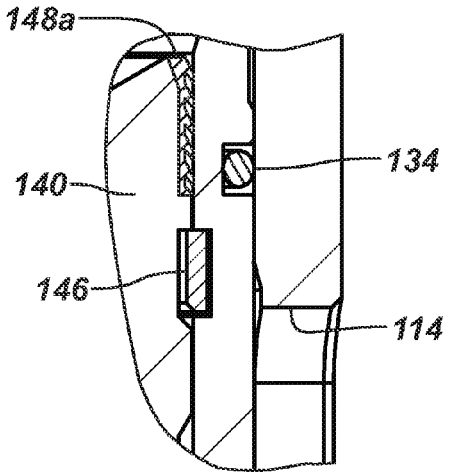
FIGS. 3C-3D illustrate details of the seat and the insert of the disclosed fracturing sleeve.
Figure 3D:
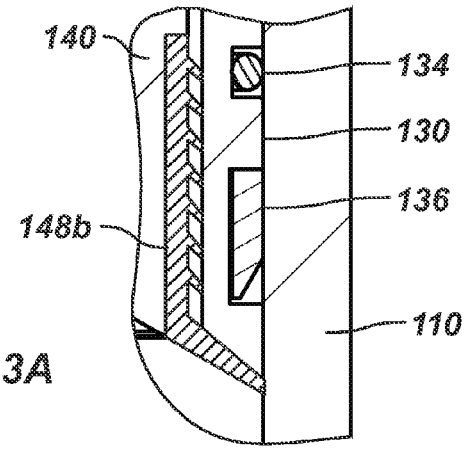

To open the sliding sleeve 100 in a fracturing operation, for example, operators drop the appropriately sized ball B downhole and pump the ball B until it reaches the seat 140 disposed in the inner sleeve 130. With the ball B seated on the seat 140, fluid pressure applied against it forces against the insert 130. The force against the seat 140 transfers to the inner sleeve 130 though the engagement of the retention ring 146 (FIG. 3C). Eventually, the pressure shears the insert 120 free of the shear ring 116 so that the inner sleeve 130 and the seat 140 can slide together in the throughbore 112.

Figure 4A:
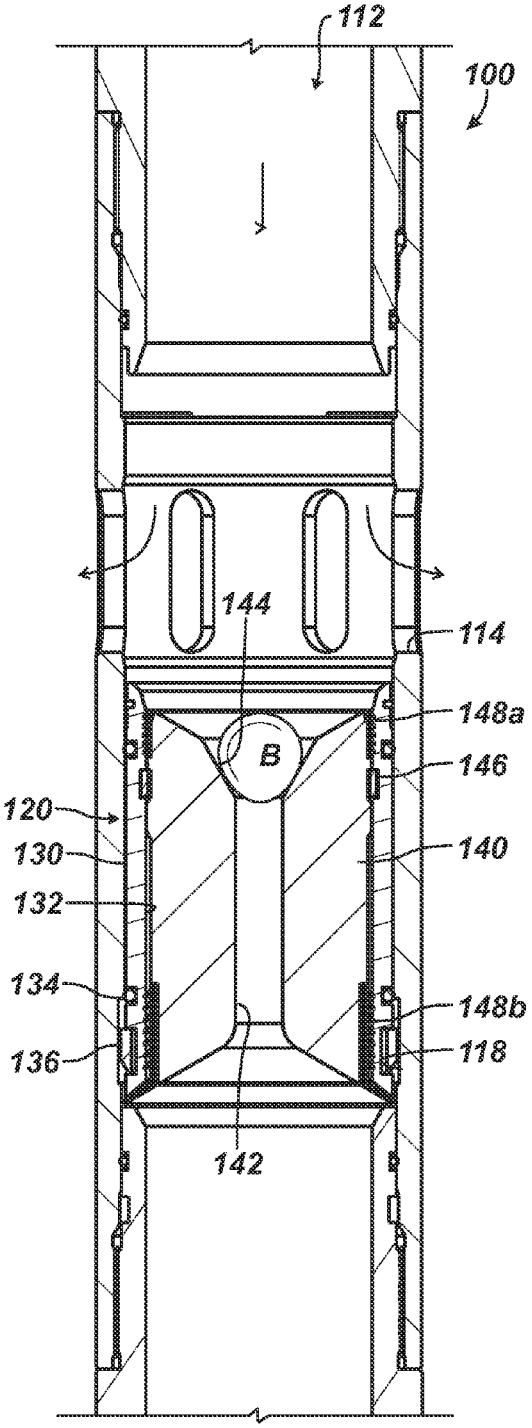
FIG. 4A illustrates the disclosed fracturing sleeve in an open condition with the seated ball.

Turning now to FIG. 4A, the sliding sleeve 100 is shown in an opened condition having the insert 120 in a second (downward) position. The insert 120 with its inner sleeve 130 and seat 140 held together by the retention ring 146 have moved together in the throughbore 112 by the applied pressure against the seated ball B. Reaching its lowermost position, the insert 120 exposes the housing's ports 114 to the throughbore 112. A lock ring 136 on the outside of the inner sleeve 130 can expand outward into an internal slot 118 in the throughbore 112 to effectively lock the inner sleeve 130 in the throughbore 112.

Figure 5A:
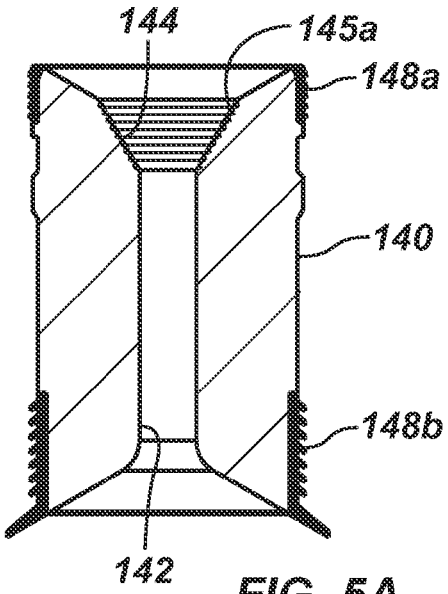
FIGS. 5A-5B illustrate seats of the present disclosure having different surfaces to engage the deployed plugs.
Figure 5B:
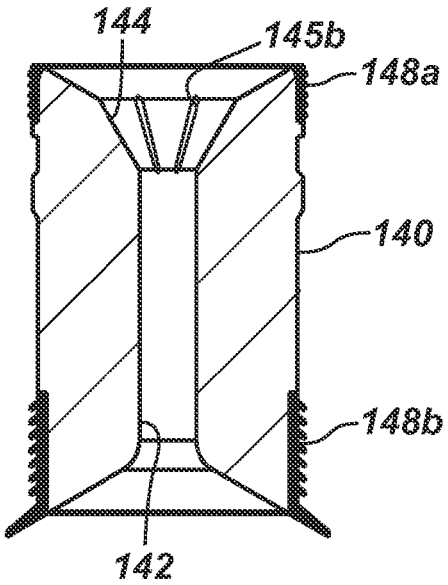

With the ball B seated on the seating surface 144 of the seat 140, fluid pressure applied above the seated ball B cannot pass through the seat's passage 142 so that the fracture treatment can be pumped out of the open sleeve 100. While fracturing, the fluid pressure can tend to wedge the ball B on the seat 140. In fact, the landing surface 144 of the seat 140 may be contoured, shaped, knurled, ribbed, or the like to facilitate wedging and fixing of the ball on the seat 140. As shown here, for example, the surface 144 of the seat 140 may be conical in nature to enhance the wedging action. Additional features can be provided to further wedge and hold the ball B against the surface 144 of the seat 140. For example, FIG. 5A shows the seat 140 having a ribs 145*a* formed on a conical surface 144, while FIG. 5B shows the seat 140 having knurls or slots 145*b* formed on a conical surface 144.

Pressures during a fracturing operation may be elevated to as high as 10-kpsi uphole of the seated ball B. The applied pressure, therefore, tends to wedge or deform the ball against the seat 140. The ball B can be made of any number of possible materials, such as aluminum, composite, phenolic, etc., and the seat 140 can also be made of any number of possible materials, such as cast iron, aluminum, composite, phenolic, etc. Use of aluminum at least for the ball B can be particularly beneficial in deforming and wedging the ball B on the seat 140.

When fracture treatment is completed for this zone, operators can drop a larger sized ball to engage the next uphole sliding sleeve to repeat the process. This can be repeated multiple times up the borehole. Eventually, once treatment operations and other procedures are completed, pressure from reverse flow (and particularly reservoir pressure) can be allowed to flow into the sliding sleeve 100. Rather than just having a ball floated to the surface and/or having a seat require milling, the insert 120 of the present sliding sleeve 100 allows the seat 140 and the ball B to flow back uphole together as a unit with the reservoir pressure or other reverse flow.

During production, for example, reservoir pressure acts from below the seat 140. The ball B wedged on the seat 140 acts as a plug for the seat's inner passage 142. In fact, the ball B engaged on the seat 140 may not float free of the seat 140 even with pressures from below reaching as high as 2 to 3-kpsi. Consequently, the reservoir pressure acting on the seat 140 from below eventually collapses the retention ring 146 that holds the seat 140 in place in the inner sleeve 130. This releases the seat 140 with the engaged ball B so they can flow uphole, while the inner sleeve 130 remains in the open condition, held by the lock ring 136.

The plugged area provided by the ball seat 140 is great enough that a particular amount of pressure can be expected to dislodge the seat 140 and begin flowing it uphole. To enhance the ability of the seat 140 to flow uphole through the tubing string and sliding sleeves 100, the outer diameter of the seat 140 can be within a desired tolerance of the inner diameter to be encountered, such as the bore 132 in the insert 130.

Figure 4B:
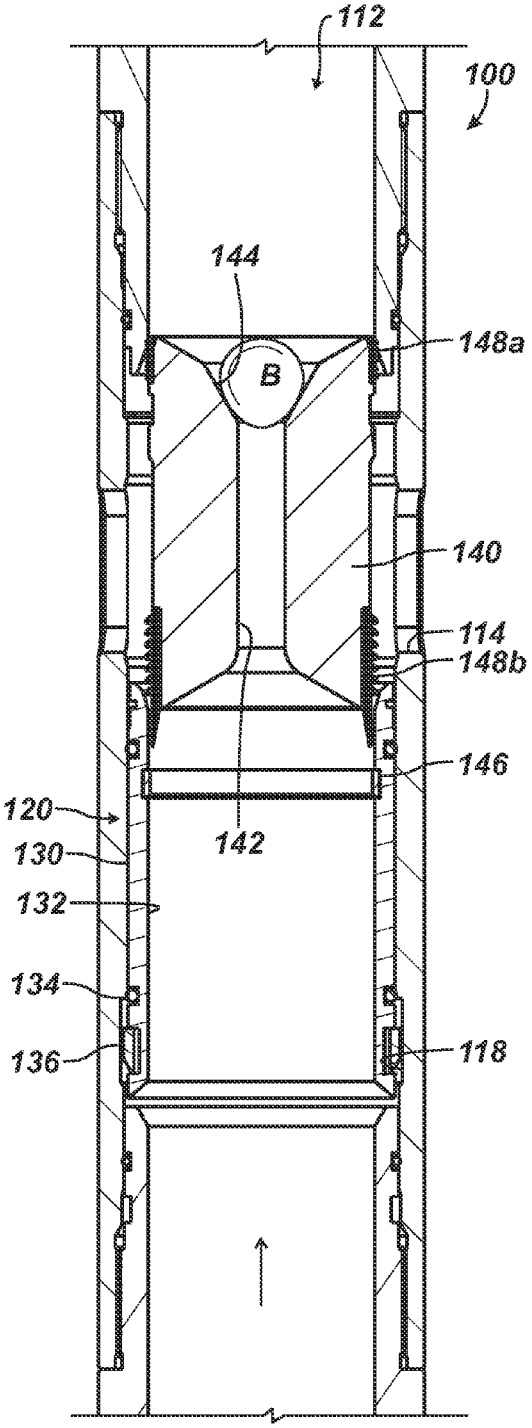
FIG. 4B illustrates the seat of the disclosed fracturing sleeve in a released condition.

To enhance the ability of the seat 140 to flow uphole through the tubing string and sliding sleeves 100, the seat 140 can have one or more seals 148*a-b* disposed thereabout to engage the inside surface of the sliding sleeve 100 and tubing string. Various types of seals could be used, such as O-rings, chevron seals, cups seals, fins, etc. In the present example, the seals 148*a-b* can include fins molded onto the outside of the seat 140 and can be composed of an elastomer or the like. The fins 148*a-b* act as swabbing members in the gap between the seat 140 and the tubing string and sliding sleeves 100 so the seat 140 and the engaged ball B can be forced uphole. As particularly shown in FIGS. 4A-4B, the fins 148*a-b* can be biased outward to engage the surrounding tubular passages through which the seat 140 passes.

The lower fin 148*b* may have an extended cup seal to bias further outward toward surrounding tubular walls. Although shown with a portion of the lower fin 148*b* extended beyond the end of the sleeve 130, this is not strictly necessary and may not be desired if it could damage the fin 148*b* (especially on opening of the sleeve 130). Instead, portion of the sleeve 130 can extend further beyond the cup seal of the fin 148*b*, or other configurations can be used.

Being able to float the ball B and the seat 140 uphole can eliminate the need to mill out the seat 140 to provide a full bore through the tubing string. Thus, a secondary intervention to retrieve the seats or to mill out the seats is not necessary. However, should the well have insufficient flowback to get one or more of the seats 140 to surface, the seat 140 can be milled out. Alternatively, a retrieval mechanism can be used to pluck the seat 140 out mechanically using coil tubing, or the seat 140 as well as the ball B may be composed of a dissolvable material.

Figure 6:
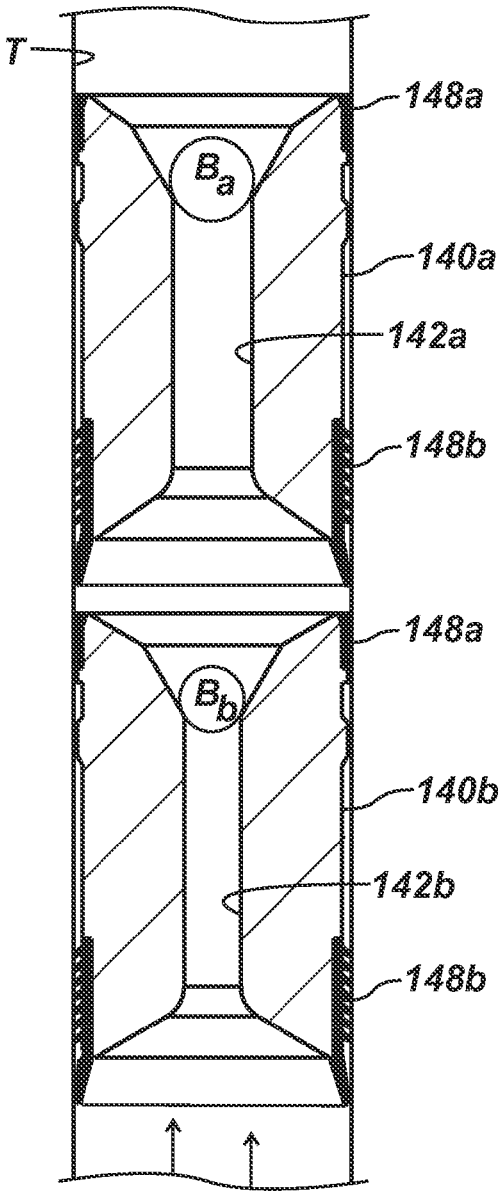
FIG. 6 illustrates adjacent seats with plugs passing through tubing with reverse flow.

Notably, when multiple sleeves having the seats and balls are subject to reverse flow back, the various seats and balls flowback toward the surface along the tubing string. This is diagrammed in FIG. 6, which shows two seats 140*a-b* released from adjacent sliding sleeves (not shown). The seats 140*a-b* have different sized passages 142*a-b* for passing the smaller balls or plugs of lower sleeves. As noted herein, each of the various balls Ba-b engage in its respective seat 144*a-b* to plug the initial downhole pressure as well as to hold the reverse flow as shown. Should one of the balls Ba-b dislodge from its seat 140*a-b*, engagement by other seats and balls can still move that seat 140*a-b*. In fact, the various seats 140*a-b* and balls Ba-b may tend to abut toward one another as the reverse pressure forces them up the tubing string T, although a slug of fluid may be trapped therebetween.

The actual pressure required to dislodge the seat 140 with the engaged ball B from the inner sleeve 120 can be configured for a particular implementation and can be based on estimates of the reservoir pressure and the like. As will be appreciated, retrieval of the seat 140 with the engaged ball B from the well through reverse flow from the reservoir pressure can be contingent on a number of factors, such as well production rates, reliability in successful intervention methods, contingency issues, and cost of system. These factors can be taken into consideration when arranging and selecting the sliding sleeves 100, the sizes of the balls B, the diameters of the seats 140, the materials used, the strength of the retention feature 146, etc.

The foregoing description of preferred and other embodiments is not intended to limit or restrict the scope or applicability of the inventive concepts conceived of by the Applicants. Although components of the seats may be shown and described as "rings," each of these components need not necessarily be completely circular or continuous, as other shapes and segmentation may be used. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Accordingly, features and materials disclosed with reference to one embodiment herein can be used with features and materials disclosed with reference to any other embodiment.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A sliding sleeve operating with a deployed plug and applied pressure and being subjected to reverse flow pressure, the sleeve comprising:

a housing defining a first bore therethrough;

an insert disposed in the first bore of the housing and having a second bore therethrough; and a seat held in a first direction in the second bore of the insert, the seat engaging the deployed plug in the first direction, the insert moving, by the applied pressure against the engaged plug in the seat, in the first direction inside the first bore from a first condition toward a second condition, the seat disengaging and moving, by the reverse flow pressure, from the second bore of the insert in a second direction opposite to the first direction, the seat comprising at least one seal disposed thereon for sealing with surrounding surfaces, including at least the second bore of the insert and the first bore of the housing, during the movement of the seat by the reverse flow pressure.

2. The sleeve of claim 1, wherein the disengaged seat is passable out of the insert in the second direction.

3. The sleeve of claim 1, wherein the housing defines a flow port communicating the first bore of the housing outside of the housing, the insert moving, by the applied pressure against the engaged plug, in the first direction inside the first bore from a closed condition toward an opened condition relative to the flow port.

4. The sleeve of claim 3, wherein the insert comprises outer seals disposed thereabout and sealing the flow port when the insert is in the closed position.

5. The sleeve of claim 1, wherein a first retention element holds the seat in the first direction in the second bore of the insert and permits release of the seat in the second direction.

6. The sleeve of claim 5, wherein the first retention element releases the seat in the second direction in the second bore in response to a predetermined level of the reverse flow pressure.

7. The sleeve of claim 5, wherein the first retention element comprises a ring engaged in a slot about the seat and held in a groove about the second bore of the insert, the ring having an end allowing passage of a shoulder of the slot in the second direction.

8. The sleeve of claim 5, wherein a second retention element temporarily holds the insert in the first condition inside the first bore of the housing.

9. The sleeve of claim 8, wherein the second retention element comprises a ring shareable in response to movement of the insert in the first direction.

10. The sleeve of claim 5, wherein a third retention element holds the insert in the second position inside the first bore.

11. The sleeve of claim 10, wherein the third retention element comprises a ring held in a slot about the insert and engageable in a groove about the first bore of the housing.

12. The sleeve of claim 1, wherein the seat comprises a surface engageable with the deployed plug and configured to at least partially hold the deployed plug in the second direction.

13. The sleeve of claim 12, wherein the surface comprises at least one of a contoured surface, a knurled surface, a ribbed surface, a conical surface, and a wedged surface.

14. The sleeve of claim 1, wherein the at least one seal comprises one or more fins disposed on the seat and adapted to seal with the second bore of the insert and the first bore of the housing when passing therethrough.

15. The sleeve of claim 1, wherein the at least one seal comprises a first seal disposed at a first end of the seat and sealing a space between the seat and the second bore of the insert while the seat is held therein.

16. The sleeve of claim 1, wherein the at least one seal comprises a second seal disposed at a second end of the seat and adapted to seal a space between the seat and the first bore of the housing.

17. A treatment system for a tubing string in a wellbore, the system comprising:

a plurality of plugs deployable down the tubing string;

a plurality of sliding sleeves disposed on the tubing string, each of the sliding sleeves opening with one of the deployed plugs and applied pressure, wherein at least one of the sliding sleeves comprises:

a housing defining a first bore and defining a flow port communicating the first bore of the housing outside of the housing; and an insert disposed in the first bore of the housing and having a second bore therethrough, the insert having a seat held in a first direction in the second bore, the seat engaging one of the deployed plugs in the first direction, the insert moving, by the applied pressure against the one deployed plug engaged in the seat, in the first direction inside the first bore from a closed position toward an opened position relative to the flow port, wherein the seat is disengageable and moveable from the insert in a second direction opposite to the first direction by the reverse flow pressure, and wherein the seat comprises at least one seal disposed thereon for sealing with surrounding surfaces, including at least the second bore of the insert and the first bore of the housing, during the movement of the seat by the reverse flow pressure.

18. The system of claim 17, wherein each of the plugs has a different size.

19. A method of treating a wellbore having a tubing string, the method comprising:

deploying at least one plug down the tubing string;

engaging the at least one plug on a seat disposed in a second bore of an insert, the insert disposed in a first bore of at least one sliding sleeve disposed on the tubing string;

opening the insert relative to a port on the at least one sliding sleeve by moving the insert in the first direction in the first bore with applied pressure in the tubing string against the at least one plug;

disengaging the seat having the at least one plug from the insert in response to reversed flow pressure in the tubing string; and flowing the disengaged seat having the at least one plug in a second direction opposite to the first direction using the reversed flow pressure in the tubing string by sealing at least one seal disposed on the seat with surrounding surfaces, including at least the second bore of the insert and the first bore of the housing, during the flowing of the seat in the second direction.

20. The method of claim 19, wherein disengaging the seat having the at least one plug from the insert in response to the reversed flow pressure in the tubing string comprises releasing a temporary retention of the seat to the insert in the at least one sliding sleeve.

21. The method of claim 19, wherein disengaging the seat having the at least one plug from the insert in response to the reversed flow pressure in the tubing string comprises locking a sleeve of the insert in the open condition in the at least one sliding sleeve and disengaging the seat from the locked sleeve.

22. The method of claim 21, wherein disengaging the seat from the locked sleeve comprises moving the seat having the at least one plug in the second direction away from the sleeve using the reversed flow pressure in the tubing string.

23. The method of claim 19, wherein engaging the at least one plug on the seat comprises at least partially holding the at least one plug on the seat in the second direction.

24. The method of claim 19, wherein moving the insert in the first direction with the applied pressure in the tubing string against the at least one plug comprises releasing a temporary retention of the insert in the at least one sliding sleeve.

* * * * *